US005463990A

United States Patent [19]

Rush, II et al.

[11] Patent Number: 5,463,990

[45] Date of Patent: Nov. 7, 1995

[54] OUTBOARD MOTOR WITH FOUR-STROKE ENGINE AND EXHAUST GAS DISCHARGE SYSTEM THEREFOR

[75] Inventors: William B. Rush, II, Antioch; Martin J. Mondek, Wonder Lake, both of Ill.; Donald K. Sullivan, Ridgeland, S.C.; Mark A. Walter, Round Lake Beach; Lawrence E. Zdanowicz, Sr., Waukegan, both of Ill.

[73] Assignee: Outboard Marine Corporation, Waukegan, Ill.

[21] Appl. No.: 318,368

[22] Filed: Oct. 5, 1994

[51] Int. Cl.[6] ..... F02F 7/00

[52] U.S. Cl. ..... 123/195 P; 123/41.82 R; 60/310; 60/320; 440/89

[58] Field of Search ..... 123/41.31, 41.82 R, 123/195 P, 196 W; 440/89; 60/310, 320, 321

[56] References Cited

U.S. PATENT DOCUMENTS

| | | | |
|---|---|---|---|
| 2,003,485 | 6/1935 | Gehres | 123/195 |
| 2,275,634 | 3/1942 | Leipert | 60/29 |
| 2,858,667 | 11/1958 | Reske | 60/31 |
| 3,052,086 | 9/1962 | Kiekhaefer et al. | 60/31 |
| 3,541,786 | 11/1970 | Sarra | 60/30 |
| 3,765,479 | 10/1973 | Fish | 165/51 |
| 3,921,398 | 11/1975 | Kashmerick | 60/310 |
| 4,187,678 | 2/1980 | Herenius | 60/321 |
| 4,214,443 | 7/1980 | Herenius | 60/321 |
| 4,604,069 | 8/1986 | Taguchi | 440/89 |
| 4,684,351 | 8/1987 | Watanabe et al. | 440/89 |
| 4,711,088 | 12/1987 | Berchem et al. | 60/321 |
| 4,759,181 | 7/1988 | Biritz | 60/321 |
| 4,799,905 | 1/1989 | Broughton et al. | 440/89 |
| 4,801,283 | 1/1989 | Ruhnke | 440/89 |
| 4,831,822 | 5/1989 | Yoshimura | 60/310 |
| 4,951,465 | 8/1990 | Torigai | 60/323 |
| 4,983,135 | 1/1991 | Boda et al. | 440/88 |
| 4,997,741 | 12/1990 | Lulloff et al. | 60/310 |
| 5,036,804 | 8/1991 | Shibata | 123/41.74 |
| 5,049,100 | 9/1991 | Yamamoto | 440/89 |
| 5,383,440 | 1/1995 | Koishikawa et al. | 123/196 W |

FOREIGN PATENT DOCUMENTS

| | | |
|---|---|---|
| 60-2485 | 7/1983 | Japan . |
| 60-2487 | 2/1985 | Japan . |

*Primary Examiner*—Noah P. Kamen
*Attorney, Agent, or Firm*—Michael, Best & Friedrich

[57] ABSTRACT

Disclosed herein is an outboard motor comprising a cylinder block including a lower horizontal drive shaft housing mounting surface, and a cylinder head mounting surface extending upwardly from the drive shaft housing mounting surface, a drive shaft housing including a peripheral outer surface including an upper end, a cylinder block mounting surface at the upper end, and a portion extending rearwardly from the cylinder block mounting surface and having therein a vertically open bore located forwardly of the outer surface, and a cylinder head comprising a cylinder block mounting surface fixed to the cylinder head mounting surface and including vertically spaced first and second recesses adapted to respectively form portions of first and second combustion chambers and respectively including first and second exhaust ports, a bottom surface extending transversely rearwardly from the cylinder block mounting surface of the cylinder head, a projection extending downwardly from the bottom surface and into the bore, and including an end surface having therein an exhaust gas outlet, and an internal exhaust passage extending between the exhaust ports and the exhaust gas outlet.

18 Claims, 5 Drawing Sheets

OUTBOARD MOTOR WITH FOUR-STROKE ENGINE AND EXHAUST GAS DISCHARGE SYSTEM THEREFOR

BACKGROUND OF THE INVENTION

The invention relates generally to outboard motors and, more particularly, to outboard motors with four-stroke internal combustion engines and, in general, to such four-stroke internal combustion engines.

Still, more particularly, the invention relates to exhaust gas discharge systems for such outboard motors and internal combustion engines.

In addition, the invention relates generally to cylinder head constructions.

Attention is directed to the following United States Patents:

U.S. Pat. No. 2,003,485 Issued Jun. 4, 1935
U.S. Pat. No. 2,275,634 Issued Mar. 10, 1942
U.S. Pat. No. 2,858,667 Issued Nov. 4, 1958
U.S. Pat. No. 3,052,806 Issued Sept. 4, 1962
U.S. Pat. No. 3,541,786 Issued Nov. 24, 1970
U.S. Pat. No. 3,765,479 Issued Oct. 16, 1973
U.S. Pat. No. 3,921,398 Issued Nov. 25, 1975
U.S. Pat. No. 4,187,678 Issued Feb. 12, 1980
U.S. Pat. No. 4,214,443 Issued Jul. 29, 1980
U.S. Pat. No. 4,684,351 Issued Aug. 4, 1987
U.S. Pat. No. 4,711,088 Issued Dec. 8, 1987
U.S. Pat. No. 4,759,181 Issued Jul. 26, 1988
U.S. Pat. No. 4,831,822 Issued May 23, 1989
U.S. Pat. No. 4,951,465 Issued Aug. 28, 1990
U.S. Pat. No. 4,977,741 Issued Dec. 18, 1990
U.S. Pat. No. 4,983,135 Issued Jan. 8, 1991
U.S. Pat. No. 5,036,804 Issued Aug. 6, 1991
U.S. Pat. No. 5,049,100 Issued Sept. 17, 1991

Attention is directed to the following Japanese Utility Models:

60-24845
60-24847

RELATED APPLICATIONS

Attention is also directed to U.S. application Ser. No. 08/318,369, filed Oct. 5, 1994 (Attorney's docket no. 72012/1290).

SUMMARY OF THE INVENTION

The invention provides an outboard motor comprising a cylinder block including a lower horizontal drive shaft housing mounting surface, and a cylinder head mounting surface extending upwardly from the drive shaft housing mounting surface, a drive shaft housing including a peripheral outer surface including an upper end, a cylinder block mounting surface at the upper end, and a portion extending rearwardly from the cylinder block mounting surface and having therein a vertically open bore located forwardly of the outer surface, and a cylinder head comprising a cylinder block mounting surface fixed to the cylinder head mounting surface and including vertically spaced first and second recesses adapted to respectively form portions of first and second combustion chambers and respectively including first and second exhaust ports, a bottom surface extending transversely rearwardly from the cylinder block mounting surface of the cylinder head, a projecting extending downwardly from the bottom surface and into the bore, and including an end surface having therein an exhaust gas outlet, and an internal exhaust passage extending between the exhaust ports and the exhaust gas outlet.

The invention also provides an outboard motor comprising a cylinder block including a lower horizontal drive shaft housing mounting surface, and a cylinder head mounting surface extending upwardly from the drive shaft housing mounting surface, a drive shaft housing including a peripheral outer surface including an upper end, a cylinder block mounting surface at the upper end, and a portion extending rearwardly from the cylinder block mounting surface and including a generally horizontal wall located below the cylinder block mounting surface and having therein a vertically open bore located forwardly of the outer surface, formed by a downwardly converging conical surface, and forming a terminal part of an exhaust gas discharge passage in the drive shaft housing, a cylinder head comprising a one-piece casting and including a cylinder block mounting surface fixed to the cylinder head mounting surface and including vertically spaced first and second recesses adapted to respectively form portions of first and second combustion chambers and respectively including first and second exhaust ports, a bottom surface extending transversely rearwardly from the cylinder block mounting surface of the cylinder head, a projecting portion extending downwardly from the bottom surface and including an end surface having therein an exhaust gas discharge port, an internal exhaust passage extending between the exhaust gas ports and the exhaust gas discharge port, and an internal cooling jacket located in heat exchanging relation to the internal exhaust gas discharge passage and in heat exchanging relation to the recesses, a projection extension member which is fabricated separately from the one-piece cylinder head, which is fixed to the end surface in downwardly depending relation, which extends through the bore, which includes an internal exhaust gas discharge conduit communicating with the exhaust gas discharge port and having an exhaust gas discharge outlet below the horizontal wall, and which also includes a cooling jacket in adjacent heat exchanging relation to the internal exhaust discharge conduit and communicating with the internal cooling jacket in the cylinder head, and a resilient grommet located between the projection extension member and the bore.

The invention also provides a cylinder head comprising a cylinder block mounting surface adapted to mate with a mounting surface on a cylinder block and including vertically spaced first and second recesses located in spaced relation to each other and adapted to respectively form portions of first and second combustion chambers and respectively including first and second exhaust ports, a bottom surface extending transversely from the cylinder block mounting surface, a projection extending downwardly from the bottom surface and including an outer peripheral surface having an upper portion, a lower portion, and a shoulder extending transversely to the upper and lower portions, and an end surface having therein an exhaust gas outlet, and a coolant discharge outlet in radially spaced adjacent relation to the exhaust gas outlet, an internal exhaust passage extending between the exhaust ports and the exhaust gas outlet, and a internal cylinder head cooling jacket at least partially surrounding the exhaust passage.

The invention also provides a cylinder head comprising a cylinder block mounting surface adapted to mate with a mounting surface on a cylinder block and including a cooling inlet port, and vertically spaced first and second recesses located in spaced relation to the coolant inlet port and adapted to respectively form portions of first and second combustion chambers and respectively including first and second exhaust ports, a bottom surface extending transversely from the cylinder block mounting surface, a projection extending downwardly from the bottom surface and including an outer peripheral surface having an upper portion, a lower portion, and a shoulder extending transversely to the upper and lower portions, and an end surface having therein an exhaust gas outlet, and a coolant discharge outlet in radially spaced adjacent relation to the exhaust gas outlet, an internal exhaust passage extending between the exhaust ports and the exhaust gas outlet, and a internal cylinder head cooling jacket at least partially surrounding the exhaust passage and extending between the coolant inlet port and the coolant discharge outlet.

Other features and advantages of the invention will become apparent to those skilled in the art upon review of the following detailed description, claims and drawings.

DESCRIPTION OF THE DRAWINGS

FIG. 2 is a schematic view of a cylinder block, a cylinder head, and a drive shaft housing incorporated in the outboard motor shown in FIG. 1.

Figure 1:
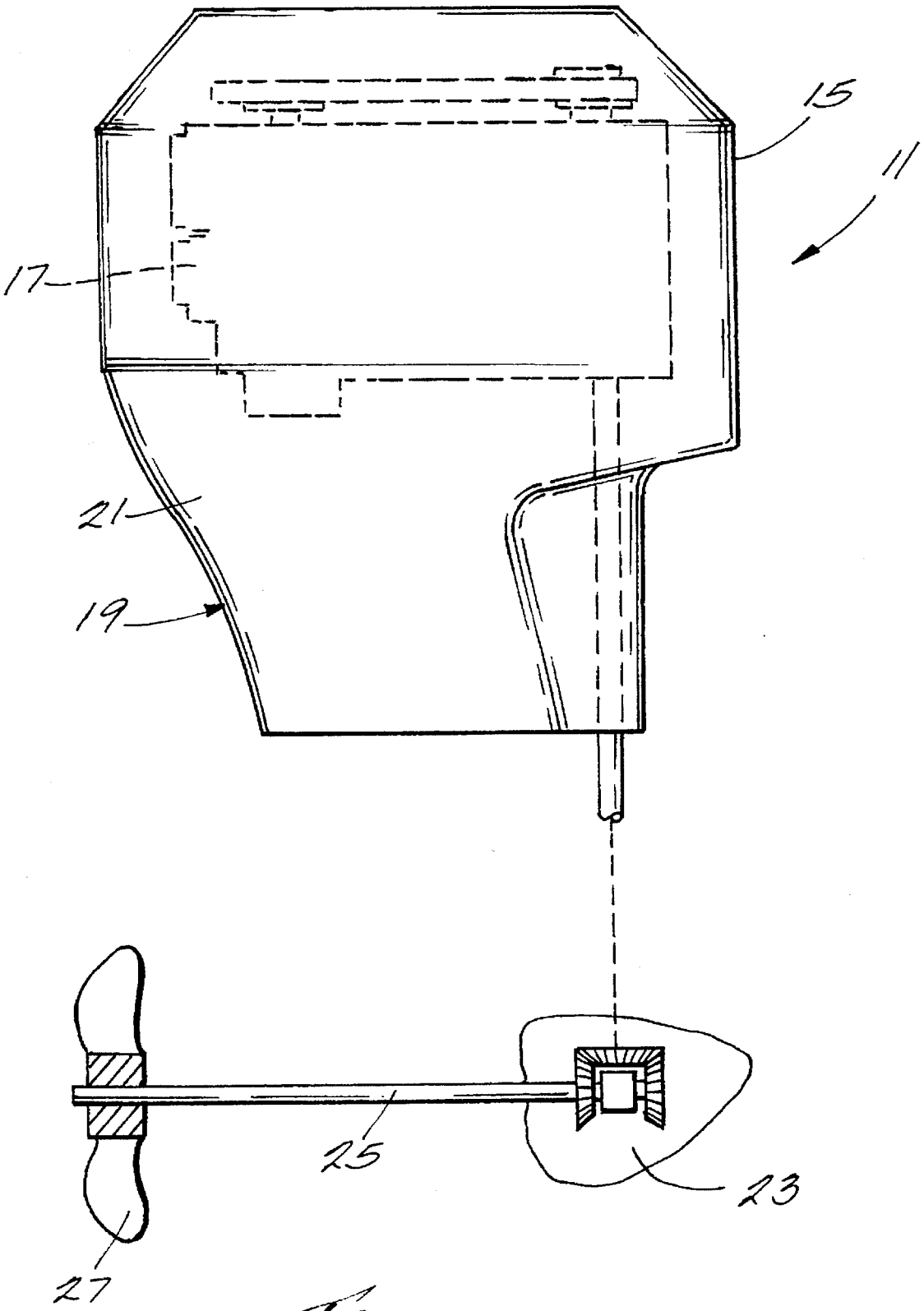
FIG. 1 is a perspective view of an outboard motor including various of the features of the invention.
Figure 1:
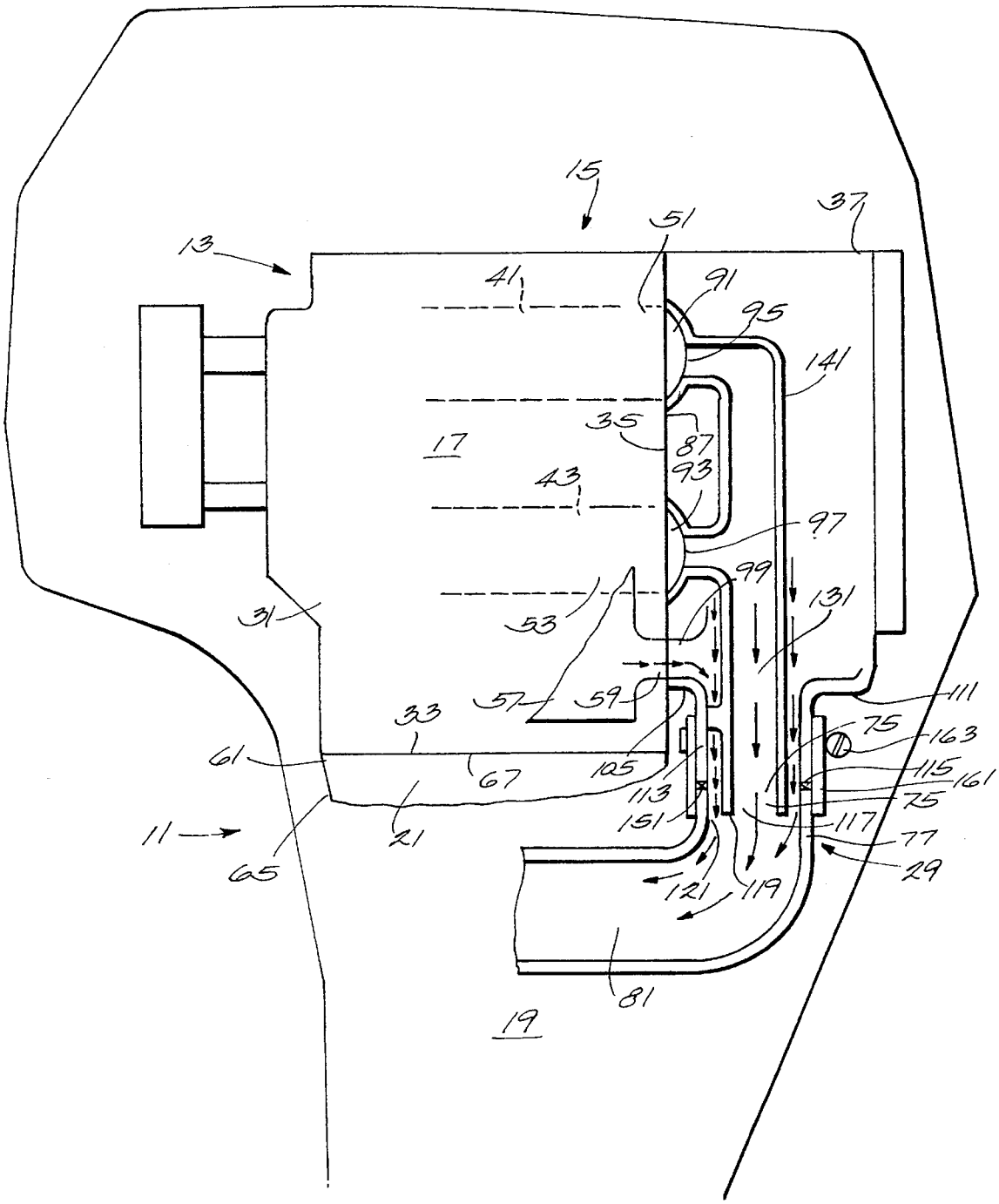

Before one embodiment of the invention is explained in detail, it is to be understood that the invention is not limited in its application to the details of the construction and the arrangements or components set forth in the following description or illustrated in the drawings. The invention is capable of other embodiments and of being practiced or being carried out in various ways. Also, it is to be understood that phraseology and terminology used herein is for the purpose of description and should not be regarded as limiting.

GENERAL DESCRIPTION

Figure 3:
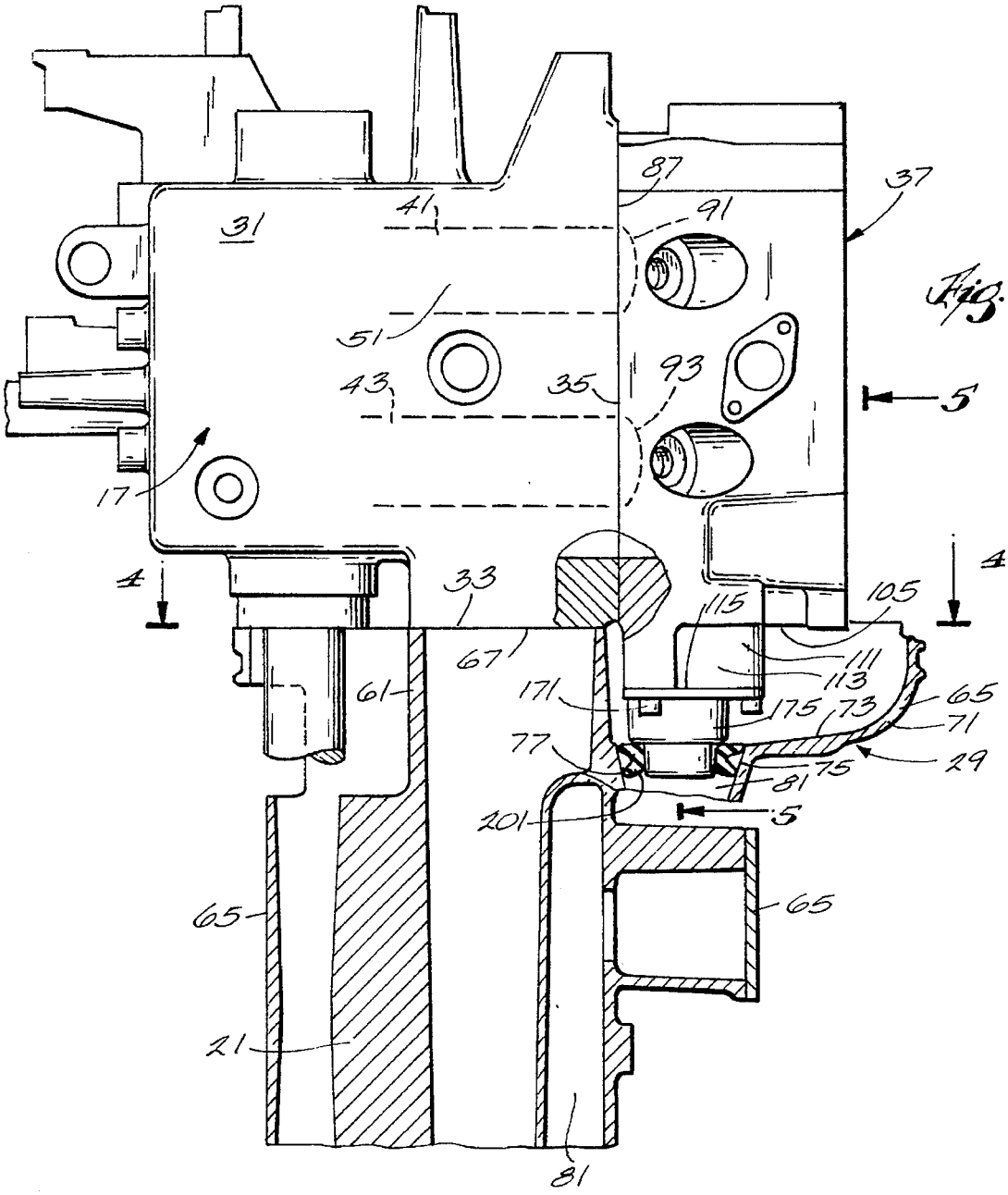
FIG. 3 is an elevational view, partially in section, of another embodiment of a cylinder block, a cylinder head, and a drive shaft housing which are embodied in an outboard motor such as shown in FIG. 1, and which embodies various of the features of the invention.
Figure 4:
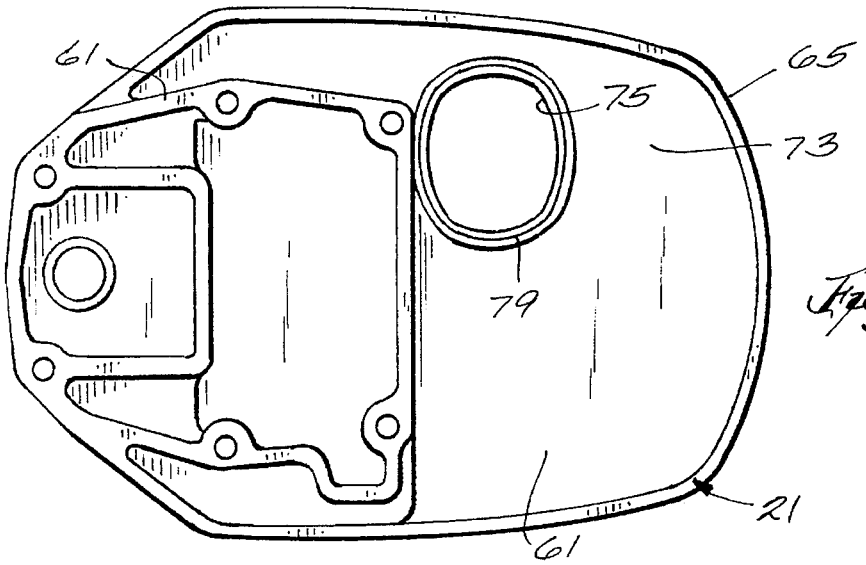
FIG. 4 is a sectional view taken along line 4—4 of FIG. 3.
Figure 5:
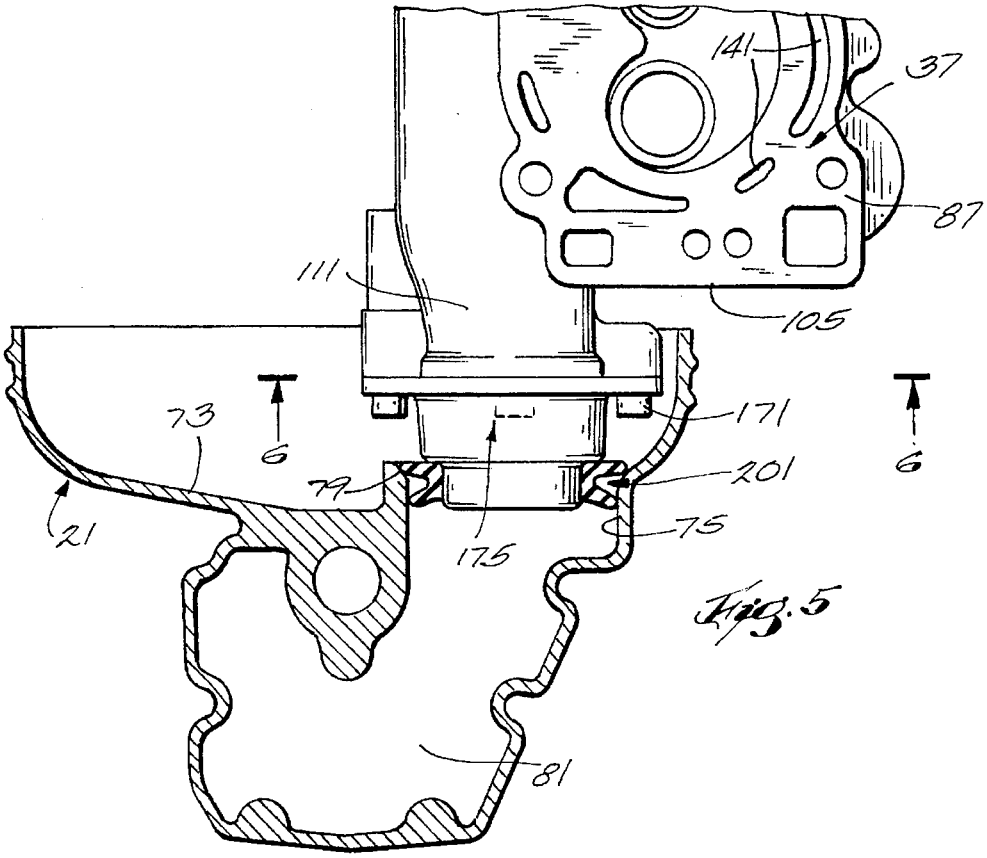
FIG. 5 is a sectional view taken along line 5—5 of FIG. 3.
Figure 6:
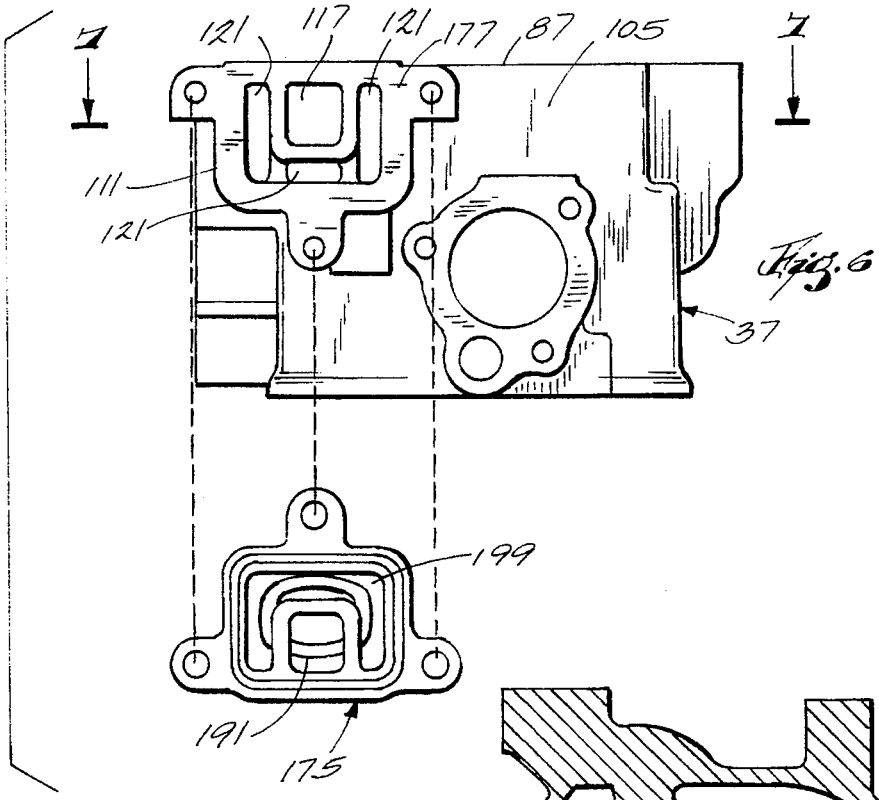
FIG. 6 is an exploded view including a portion taken along line 6—6 of FIG. 5 and a portion illustrating an attached member.
Figure 8:
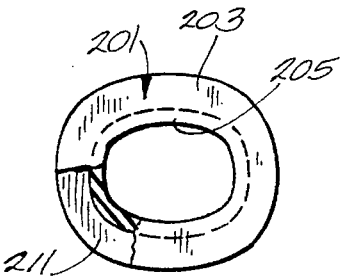
FIG. 8 is a partially broken away view of a grommet incorporated in the construction shown in FIG. 3.
Figure 7:
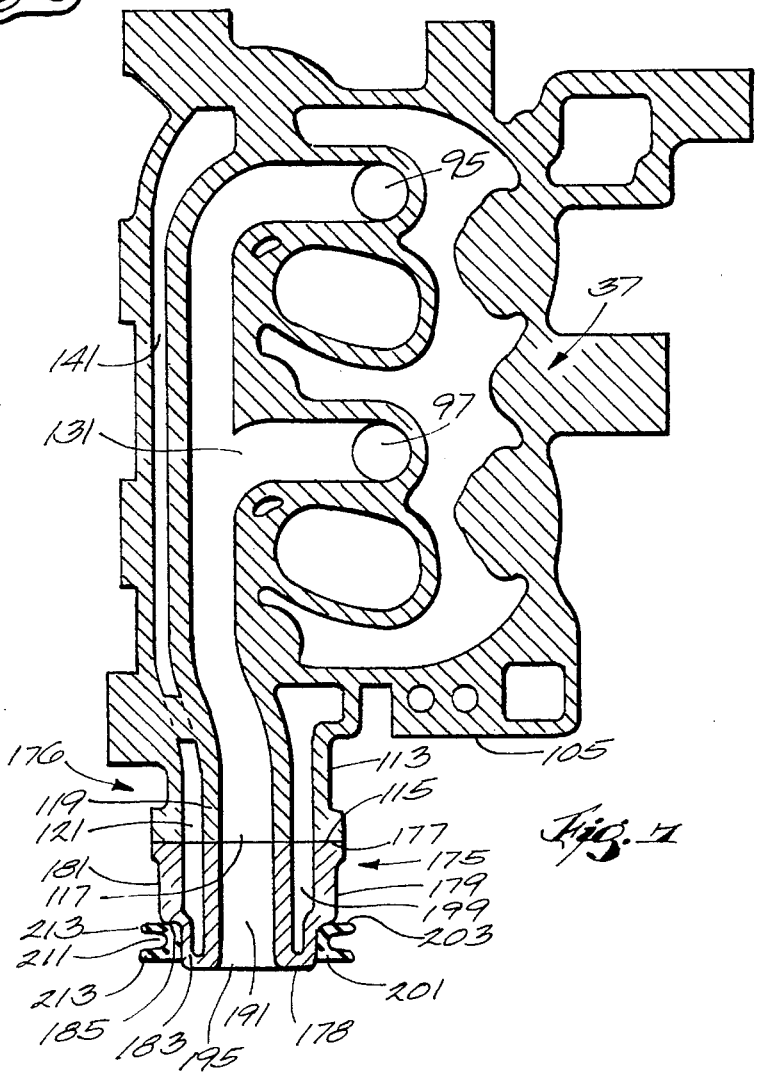
FIG. 7 is a sectional view taken along line 7—7 of FIG. 6.

Shown schematically (and partially) in the drawings is an outboard motor 11 comprising a propulsion unit 13 including a power head 15 comprising a two cylinder, four stroke internal combustion engine 17, and a lower unit 19 which is fixed to the power head 15 and which includes an upper drive shaft housing 21 and a lower gear case 23 fixed to the bottom of the drive shaft housing 21 and including a rotatable propeller shaft 25 driven by the engine 17 and having mounted thereon a propeller 27. The engine 17 and the drive shaft housing 21 include (see FIGS. 2 and 3) an exhaust gas discharge system 29 which effectively conveys exhaust gas from the engine 17 to the drive shaft housing 21.

The engine 17 shown in FIG. 2 includes a cylinder block 31 including a lower horizontally extending, generally planar, drive shaft housing mounting surface 33, and a rearwardly located cylinder head mounting surface 35 extending upwardly from the drive shaft housing mounting surface 33. The cylinder block 31 defines upper and lower, generally horizontally extending cylinders 41 and 43 which partially define respective combustion chambers 51 and 53 and which open into the cylinder head mounting surface 35. In addition, the cylinder block 31 defines a cylinder block cooling water jacket 57 which can be supplied cooling water in any suitable manner and which includes a cooling water discharge port 59 in the cylinder head mounting surface 35.

The drive shaft housing 21 includes a top 61, a bottom (not shown) and a peripheral or outer wall 65 extending between the top 61 and the bottom, together with a cylinder block mounting surface 67 located at the top 61 of the drive shaft housing 21 and suitably fixed to the drive shaft housing mounting surface 33 of the cylinder block 31. The drive shaft housing 21 also includes, rearwardly of and below the cylinder block mounting surface 67, a vertically open bore 75 which is formed by an endless wall 77 located interiorly of the outer wall 65 and which, as will be apparent, constitutes a part of an exhaust gas discharge passage 81 which, at its lower end, is adapted to discharge exhaust gas either directly to the surrounding water from the drive shaft housing 21, or to discharge the exhaust gas to the surrounding water through the gear case 23 and attached propeller 27.

The engine 17 also includes a cylinder head 37 comprising a one-piece casting which is preferably fabricated from aluminum by the lost-foam casting process, and which includes a cylinder block mounting surface 87 which is suitably fixed to the cylinder head mounting surface 35 of the cylinder block 31 and which has therein vertically spaced upper and lower recesses 91 and 93 which respectively register with the cylinders 41 and 43 and, in general, complete formation of the combustion chambers 51 and 53 and which respectively include therein exhaust ports 95 and 97. Also provided in the cylinder block mounting surface 87 is a cooling water inlet port 99 which is located in registry with the cooling water discharge port 59 for receipt therefrom of cooling water.

The cylinder head 37 also includes a lower or bottom surface 105 which extends transversely and rearwardly from the cylinder block mounting surface 87, and a projecting portion or projection 111 which extends downwardly from the bottom surface 105 and enters into the bore 75 in the top rearward portion 71 of the drive shaft housing 21. The projecting portion 111 includes an outer peripheral wall 113 and a lower end surface 115 having therein an exhaust gas discharge outlet 117 formed, in part, by an inner endless wall 119, and an annular cooling water discharge 121 located in surrounding and radially spaced relation to the exhaust gas discharge outlet 117 and formed, in part, by the inner endless wall 119 and, in part, by the outer peripheral wall 113 of the projecting portion 111.

Internally thereof, the cylinder head 35 includes an exhaust gas passage 131 which extends vertically between the exhaust ports 95 and 97 and the exhaust gas discharge outlet 117, and an internal cooling water passage or jacket 141 which is fragmentarily shown and which extends, at least in part, in surrounding heat exchanging relation to the internal exhaust passage 131 and communicates between the cooling water inlet port 99 and the cooling water discharge outlet 121. The cooling water passage or jacket 141 can also extend into adjacent heat exchanging relation to the recesses 91 and 93.

The outer peripheral wall 113 of the projecting portion 111 is located in registry with the endless wall 77 which forms the bore 75 and which also partially provides the exhaust gas discharge passage 81 in the drive shaft housing 21. Located between the peripheral wall 113 of the projecting portion 111 and the endless wall 77 in the drive shaft housing 21 is a suitable sealing member 151 which prevents escape of exhaust gas and cooling water from the interface between the peripheral outer wall 113 and the endless wall 77.

In order to retain the sealing member 151 in place and to additionally prevent escape of exhaust gas and cooling water, a rubber sleeve or connector 161 is located in enclosing and surrounding relation to the end portions of the outer peripheral wall 113 of the projecting portion 111 and the endless wall 77 of the drive shaft housing 21. The sleeve 161 is held in tightly fitting engagement with the outer peripheral wall 113 and the endless wall 77 by a circular band-type clamp 163 which can be tightened or loosened by a screw driver. Any other suitable clamp can be provided.

As a consequence, both exhaust gas and cooling water are discharged into the exhaust gas discharge passage 81 in the drive shaft housing 21, while escape thereof from the interface between the projecting portion 111 and the drive shaft housing 21 is prevented, which interface is located rearwardly of and below the engagement between the cylinder block mounting surface 67 of the drive shaft housing 21 and the drive shaft housing mounting surface 33 of the cylinder block 31.

Shown in FIGS. 3 through 8 is another embodiment of a system for conducting exhaust gas from the combustion chambers of a two cylinder, four stroke internal combustion engine to a drive shaft or exhaust housing which supports the engine and forms part of an outboard motor. Where the construction of FIGS. 3 through 8 is similar to the construction of FIG. 2, the same reference numerals have been applied.

More particularly, the engine 17 shown in FIGS. 3 through 8 includes a cylinder block 31 including a lower horizontally extending, generally planar, drive shaft housing mounting surface 33, and a rearwardly located cylinder head mounting surface 35 extending upwardly from the drive shaft housing mounting surface 33. The cylinder block 31 defines upper and lower, generally horizontally extending cylinders 41 and 43 which partially define respective combustion chambers 51 and 53 and which open into the cylinder head mounting surface 35. In addition, the cylinder block 31 defines a cylinder block cooling water jacket (not shown) which includes any suitable arrangement for supplying and discharging cooling water.

The drive shaft housing 21 includes a top 61, a bottom (not shown), and a peripheral or outer wall 65 extending between the top 61 and the bottom, together with a cylinder block mounting surface 67 located at the top 61 of the drive shaft housing 21 and suitably fixed to the drive shaft housing mounting surface 33 of the cylinder block 31. The drive shaft housing 21 also includes a rearward portion 71 extending rearwardly from the cylinder block mounting surface 67 to a rearward portion of the outer wall 65 and including therein a generally horizontal wall 73 located below and rearwardly of the horizontal cylinder block mounting surface and having therein a vertically open bore 75 which is formed by a downwardly convergent surface 79 and which constitutes a part of an exhaust gas discharge passage 81 which, at its lower end, is adapted to discharge exhaust gas either directly to the surrounding water from the drive shaft housing 21, or to discharge the exhaust gas to the surrounding water through the gear case 23 and attached propeller 27.

The engine 17 also includes a cylinder head 37 comprising a one-piece casting which is preferably fabricated from aluminum by the lost-foam casting process, and which includes a cylinder block mounting surface 87 suitably fixed to the cylinder head mounting surface 35 of the cylinder block 31 and having therein vertically spaced upper and lower recesses 91 and 93 which respectively register with the cylinders 41 and 43 and, in general, complete formation of the combustion chambers 51 and 53 and which respectively include therein (see FIG. 7) exhaust ports 95 and 97.

The cylinder head 37 also includes a lower or bottom surface 105 which extends transversely and rearwardly from the cylinder block mounting surface 87, and a projecting portion 111 which extends downwardly from the bottom surface 105 and which includes (see FIG. 7) an outer peripheral wall 113 and a lower end surface 115 having therein an exhaust gas discharge port 117 formed, in part, by an inner endless wall 119, and a cooling water port or opening 121 which is at least partially annular and which is located in radially spaced, adjacent relation to the exhaust gas discharge port 117 and formed, in part, by the inner endless wall 119 and, in part, by the outer peripheral wall 113 of the projecting portion 111.

Internally thereof, the cylinder head 37 includes (see FIG. 7) an exhaust gas passage 131 which extends vertically between the exhaust ports 95 and 97 and the exhaust gas discharge port 117, and an internal cooling water passage or jacket 141 which extends, at least in part, in surrounding heat exchanging relation to the internal exhaust gas discharge passage 131, which communicates with suitable inlet and outlet conduits (not shown), and which includes the beforementioned port or opening 121 in the end surface 115 of the projecting portion 111. The cooling water passage or jacket 141 can also extend into adjacent heat exchanging relation to the recesses 91 and 93.

Suitably fixed, as by one or more screws 171, to the end surface 115 of the projecting portion 111 is a projection extension member 175 which is fabricated from aluminum separately from the one-piece cylinder head 37. The projecting portion 111 and the projection extension member 175 together constitute a projection 176 extending downwardly from the lower surface 105 of the cylinder head 37.

The projection extension member 175 extends through the bore 75 in the horizontal wall 73 and includes (see especially FIG. 7) an upper surface 177 fixed to the end surface 115 of the projecting portion 111, a lower end surface 178, and an outer peripheral surface 179 extending between the upper and lower surfaces 177 and 178 and having an upper portion 181, a lower portion 183, and an annular horizontal shoulder 185 extending between the upper and lower portions 181 and 183. In addition, the projection extension member 175 includes an internal exhaust gas discharge conduit or bore 191 communicating with the exhaust gas discharge port 117 located in the end surface 115 of the projecting portion 111 of the cylinder head 37 and terminating, at the lower end thereof, in an exhaust gas outlet 195 located in the lower end surface 178 of the projection extension member 175.

In addition, the projection extension member 175 includes an internal coolant jacket 199 which at least partially surrounds the exhaust gas discharge conduit 191 and which solely communicates through the upper surface 177 with the opening 121 of the coolant jacket 141 in the cylinder head 37.

Extending between the shoulder 185 and the lower portion 183 of the outer surface 179 of the projection extension member 175 and the conical wall or surface 79 of the bore 75 is a grommet 201 which is fabricated of resilient rubber or rubber-like material, and which serves to prevent escape of exhaust gas between the projection extension member 175 and the bore 75 in the horizontal wall 73 of the drive shaft housing 21.

The grommet 201 includes an upper surface 203 and an internal axial bore 205 which respectively engage the shoulder 185 and the lower portion 183 of the outer surface 179 of the projection extension member 175.

The outer periphery of the grommet 175 includes a relatively deep annular groove 211 which provides axially spaced leaves or arms 213 which are particularly flexible, and which are particularly adapted to sealingly engage the downwardly convergent conical surface 79 of the bore 75 incident to location of the engine 17 on the top of the drive shaft housing 21 and insertion of the projection extension member 175 into the bore 75 in the horizontal wall 73. Such insertion serves to seat the resilient grommet 201 against the conical wall or surface 79 of the bore 75 and against the shoulder 185 and against the lower portion 183 of the outer surface 179 of the projection extension member 175, whereby to sealingly engage both the lower horizontal wall 73 of the drive shaft housing 21 and the projection extension member 175.

Various of the features of the invention are set forth in the following claims.

We claim:

1. An outboard motor comprising a cylinder block including a lower horizontal drive shaft housing mounting surface, and a cylinder head mounting surface extending upwardly from said drive shaft housing mounting surface, a drive shaft housing including a peripheral outer surface including an upper end, a cylinder block mounting surface at said upper end, and a portion extending rearwardly from said cylinder block mounting surface and having therein a vertically open bore located forwardly of said outer surface, and a cylinder head comprising a cylinder block mounting surface fixed to said cylinder head mounting surface and including vertically spaced first and second recesses adapted to respectively form portions of first and second combustion chambers and respectively including first and second exhaust ports, a bottom surface extending transversely rearwardly from said cylinder block mounting surface of said cylinder head, a projection extending downwardly from said bottom surface and into said bore, and including an end surface having therein an exhaust gas outlet, and an internal exhaust passage extending between said exhaust ports and said exhaust gas outlet.

2. An outboard motor in accordance with claim 1 wherein said rearward upper portion of said drive shaft housing includes therein a generally horizontal wall having therein said bore.

3. An outboard motor in accordance with claim 2 wherein said horizontal wall is located below said cylinder head mounting surface.

4. An outboard motor in accordance with claim 1 wherein said bore forms a terminal part of an exhaust gas discharge passage in said drive shaft housing.

5. An outboard motor in accordance with claim 4 and further including a resilient grommet located between said projection and said bore.

6. An outboard motor in accordance with claim 5 wherein said bore is formed by a downwardly converging conical surface.

7. An outboard motor in accordance with claim 1 wherein said projection includes an upper part which is fabricated as part of a one-piece casting said recesses, and a lower part which is fabricated separately therefrom, which is fixed thereto in downwardly depending relation, and which includes a portion of said internal exhaust gas discharge passage.

8. An outboard motor in accordance with claim 1 wherein said cylinder head also includes an internal cooling passage located in heat exchanging relation to said internal exhaust gas discharge passage.

9. An outboard motor in accordance with claim 8 wherein said internal cooling jacket is also located in heat exchanging relation to said recesses.

10. An outboard motor in accordance with claim 8 wherein said projection includes a lower part which is fabricated separately from said cylinder head, which is fixed thereto in downwardly depending relation, and which includes a portion of said internal exhaust gas discharge passage, and a portion of said internal cooling passage.

11. An outboard motor in accordance with claim 1 wherein said cylinder head includes a one-piece main portion including a projecting portion, and a projection extension member fixed to said projecting portion and including an outer peripheral surface including an upper portion, a lower portion, and a transversely extending shoulder intermediate said upper and lower portions.

12. An outboard motor in accordance with claim 11 wherein said bore is formed by a downwardly converging conical surface.

13. An outboard motor in accordance with claim 12 and further including a resilient grommet located between said projection extension member and said bore and in sealing engagement with said lower portion, with said shoulder, and with said conical surface.

14. An outboard motor in accordance with claim 1 wherein said projection includes an outer peripheral surface including an upper portion, a lower portion, and a transversely extending shoulder intermediate said upper and lower portions.

15. An outboard motor in accordance with claim 14 wherein said bore is formed by a downwardly converging conical surface, and further including a resilient grommet located between said projection and said bore and in sealing engagement with said lower portion, with said shoulder, and with said conical surface.

16. An outboard motor comprising a cylinder block including a lower horizontal drive shaft housing mounting surface, and a cylinder head mounting surface extending upwardly from said drive shaft housing mounting surface, a drive shaft housing including a peripheral outer surface including an upper end, a cylinder block mounting surface at said upper end, and a portion extending rearwardly from said cylinder block mounting surface and including a generally horizontal wall located below said cylinder block mounting surface and having therein a vertically open bore located forwardly of said outer surface, formed by a downwardly converging conical surface, and forming a terminal part of an exhaust gas discharge passage in said drive shaft housing, a cylinder head comprising a one-piece casting and including a cylinder block mounting surface fixed to said cylinder head mounting surface and including vertically spaced first and second recesses adapted to respectively form portions of first and second combustion chambers and respectively including first and second exhaust ports, a bottom surface extending transversely rearwardly from said cylinder block mounting surface of said cylinder head, a projection portion extending downwardly from said bottom surface and including an end surface having therein an exhaust gas discharge port, an internal exhaust passage extending between said exhaust gas ports and said exhaust gas discharge port, and an internal cooling jacket located in heat exchanging relation to said internal exhaust gas discharge passage and in heat exchanging relation to said recesses, a projection extension member which is fabricated separately from said one-piece cylinder head, which is fixed to said end surface in downwardly depending relation, which extends through said bore, which includes an internal exhaust gas discharge conduit communicating with said exhaust gas discharge port and having an exhaust gas discharge outlet below said horizontal wall, and which also includes a cooling jacket in adjacent heat exchanging relation to said internal exhaust discharge conduit and communicating with said internal cooling jacket in said cylinder head, and a resilient grommet located between said projection extension member and said bore.

17. A cylinder head comprising a cylinder block mounting surface adapted to mate with a mounting surface on a cylinder block and including vertically spaced first and second recesses located in spaced relation to each other and adapted to respectively form portions of first and second combustion chambers and respectively including first and second exhaust ports, a bottom surface extending transversely from said cylinder block mounting surface, a projection extending downwardly from said bottom surface and including an outer peripheral surface having an upper portion, a lower portion, and a shoulder extending transversely to said upper and lower portions, and an end surface having therein an exhaust gas outlet, and a coolant discharge outlet in radially spaced adjacent relation to said exhaust gas outlet, an internal exhaust passage extending between said exhaust ports and said exhaust gas outlet, and a internal cylinder head cooling jacket at least partially surrounding said exhaust passage.

18. A cylinder head comprising a cylinder block mounting surface adapted to mate with a mounting surface on a cylinder block and including a cooling inlet port, and vertically spaced first and second recesses located in spaced relation to said coolant inlet port and adapted to respectively form portions of first and second combustion chambers and respectively including first and second exhaust ports, a bottom surface extending transversely from the cylinder block mounting surface, a projection extending downwardly from said bottom surface and including an outer peripheral surface having an upper portion, a lower portion, and a shoulder extending transversely to said upper and lower portions, and an end surface having therein an exhaust gas outlet, and a coolant discharge outlet in radially spaced adjacent relation to said exhaust gas outlet, an internal exhaust passage extending between said exhaust ports and said exhaust gas outlet, and a internal cylinder head cooling jacket at least partially surrounding said exhaust passage and extending between said coolant inlet port and said coolant discharge outlet.

* * * * *